United States Patent [19]

Brühmann

[11] Patent Number: 4,796,581

[45] Date of Patent: Jan. 10, 1989

[54] CENTRIFUGAL RPM GOVERNOR FOR INTERNAL COMBUSTION ENGINES

[75] Inventor: Werner Brühmann, Stuttgart, Fed. Rep. of Germany

[73] Assignee: Robert Bosch GmbH, Stuttgart, Fed. Rep. of Germany

[21] Appl. No.: 584,961

[22] Filed: Feb. 29, 1984

[30] Foreign Application Priority Data

Jun. 16, 1983 [DE] Fed. Rep. of Germany ..... 3321715

[51] Int. Cl.[4] ..... F02M 39/00

[52] U.S. Cl. ..... 123/373; 123/364; 411/282; 411/395; 411/333

[58] Field of Search ..... 123/372, 373, 364; 411/277, 282, 305, 334, 333, 395

[56] References Cited

U.S. PATENT DOCUMENTS

| | | | |
|---|---|---|---|
| Re. 30,406 | 9/1980 | Johanson | 411/259 |
| 2,922,211 | 1/1960 | Boyd | 411/305 |
| 3,234,927 | 2/1966 | Cramer, Jr. | 123/140 |
| 3,662,804 | 5/1972 | Krywitsky | 411/259 |
| 3,946,715 | 3/1976 | Staudt | 123/140 R |
| 4,038,958 | 8/1977 | Susuki | 123/373 |
| 4,267,808 | 5/1981 | Djordjeric et al. | 123/36.7 |
| 4,281,630 | 8/1981 | Bruhmann | 123/373 |
| 4,286,558 | 9/1981 | Djordjevic et al. | 123/373 |

FOREIGN PATENT DOCUMENTS

| | | | |
|---|---|---|---|
| 1011223 | 6/1957 | Fed. Rep. of Germany | 123/373 |
| 804279 | 11/1958 | United Kingdom | 123/373 |

*Primary Examiner*—Carl Stuart Miller

*Attorney, Agent, or Firm*—Edwin E. Greigg

[57] ABSTRACT

The governor includes a torque-control capsule actuated by a governor member that adjusts in accordance with rpm and disposed in a force-transmitting member subject to the force of a governor spring, by means of which torque-control capsule both the onset and control stroke (b) of torque control are adjustable or settable in an infinitely graduated manner without affecting one another. The torque-control capsule has a stop bolt inserted in a stepped longitudinal bore of a stop housing, a torque-control spring and an adjusting screw, which forms an abutment for the torque-control spring. The adjusting screw is adjustable in an infinitely graduated manner and is secured in a positionally fixed manner inside the stop housing in the vicinity of an internal thread. By turning the adjusting screw, an infinitely graduated variation of the initial stress of the torque-control spring can be performed, even in the installed state, without affecting the previously set torque-control stroke (b), and by varying the depth of threaded insertion of the torque-control capsule inside the force-transmitting member, the protruding dimension (b) corresponding to the torque-control stroke is adjustable without affecting the initial stress of the torque-control spring.

5 Claims, 2 Drawing Sheets

CENTRIFUGAL RPM GOVERNOR FOR INTERNAL COMBUSTION ENGINES

This application is copending with application Ser. No. 584,951 filed Feb. 29, 1984, now allowed.

BACKGROUND OF THE INVENTION

The invention is based on a centrifugal rpm governor for internal combustion engines. A centrifugal rpm governor of this type is known (German Patent No. 1 011 223), in which the adapting device, embodied as a torque-control capsule or torque-control spring capsule is threaded into a force transmitting member embodied as a lever; the initial stress of the torque-control spring determines the onset of torque control, while the magnitude of protrusion of the stop bolt determines the adapting stroke. With this torque-control capsule, the initial stress of the torque-control spring must be varied in order to vary the onset of torque control, yet this can only be accomplished after removal of the torque-control capsule and replacement of the torque-control spring, and/or by adding or exchanging compensating shims. When the torque-control capsule is reassembled, or after the compensating shims are exchanged, the magnitude of stop bolt protrusion must be adjusted once again. An apparatus of this kind is extremely time-consuming, and variation of the initial stress of the torque-control spring can be performed only in stages because of the compensating shims that have to be inserted.

It is also known from the above patent that the control distance traveled for torque control is determined by the magnitude of protrusion of a section of the stop bolt that protrudes beyond a stop face on the force transmitting lever oriented toward the governor member. The torque-control capsule comprises a structural unit that can be readjusted only outside the governor, which furthermore also has the disadvantages already noted. This known torque-control capsule thus allows neither an accurate, infinitely graduated adjustment of the initial stress of the torque-control spring nor a correction of the initial spring stress in the installed state that would leave the torque control stroke unaffected. Yet in most cases, a correction of this kind is required in order to compensate for governor and engine tolerances.

OBJECT AND SUMMARY OF THE INVENTION

The centrifugal rpm governor according to the invention has the advantage over the prior art that an infinitely graduated adjustment of the initial stress of the torque-control spring, which determines the onset of torque control, can be accomplished both outside the governor and while the torque-control capsule is installed on the governor or engine, without varying the torque-control path length that is fixed by the installed position of the torque-control capsule. As a result, more accurate and rapid adjustment of the onset of torque control is attainable, either while the engine is running or on the test bench. Because of the adjusting screw that is secured in a positionally fixed manner inside the stop housing in the vicinity of the inner thread thereof, the further advantage also exists that the structural length of the torque-control capsule embodied according to the invention is no greater than the length of capsules previously used in corresponding types of governor, and the torque-control capsules heretofore used can be removed and replaced by the capsules embodied in accordance with the invention without making structural changes in the existing governor.

Advantageous further embodiments of and improvements to the centrifugal rpm governor disclosed are possible. For instance, as provided, the adjusting screw is embodied by a first adjusting ring provided with a central opening for tool access, and it is fixed in its installed position by a second adjusting ring, likewise located inside the stop housing, so that the required positional securing of the first adjusting ring is attained without having protruding structural parts.

A particularly compact structure is attained by means of the adjusting screw, by a single, cup-shaped adjusting ring, since the adjusting ring, being deformed into an oval shape in a portion of its overall length in the vicinity of the sheath-like wall, can by means of this easily attained shaping therefore be used as a self-securing element, and additional securing means are unnecessary. In any event, adjusting screws used without counternuts or counterscrews are already known, the positional fixation of which then has to be assured by a liquid securing medium, for instance a microencapsulated plastic. This provision is difficult to put into practice in oil-filled governors and is a potential source of malfunction. This securing medium requires an axial stress on the thread exceeding the usual tightening torque of screws, yet in torque-control capsules, because of the initial stress of the adapting spring, such an axial stress is not exerted. Furthermore, the possibility of retroactive adjustment is limited both in terms of time and numbers. With non-hardening plastic seals in the area of the thread, the securing moment is disadvantageously highly dependent on the thread tolerance and on operating temperature.

If the adjusting screw is embodied according to one modification, then as a result of the deformed, sheath-like wall there is no hindrance to the installation of the adjusting screw, because the outer thread retains its normal, circular contour in the vicinity of the bottom. If the adjusting screw is pressed into an oval shape by a magnitude that is slightly above the maximum possible thread tolerances, then a particularly important advantage of the invention is attained, in that when the adjusting screw is mounted it remains permanently deformed by a dimension dependent on the tolerances of the two cooperating threads, while a virtually constant remnant stress, which is specific to the material used and dependent on the thickness of the wall, assures a reliable fixation of the rotational position independently of the operating temperature or of how often adjustment is performed. These advantages are not found in any known securing means. The tool access opening disposed in the center of the bottom of the adjusting screw facilitates mounting of the adjusting screw and permits shaping and deformation of the wall without impairment by the tool. As a result of the hardened spring plate used, the specific stress on the torque-control spring abutment is reduced, and the guidance and capacity of the spring are improved. In order to avoid a decrease in the initial stress of the torque-control spring caused by spring settling over the life of the governor, the abutment, which in order to receive the spring is disposed in a depression, would otherwise have to be hardened on the adjusting screw, which would be more costly and labor-intensive.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
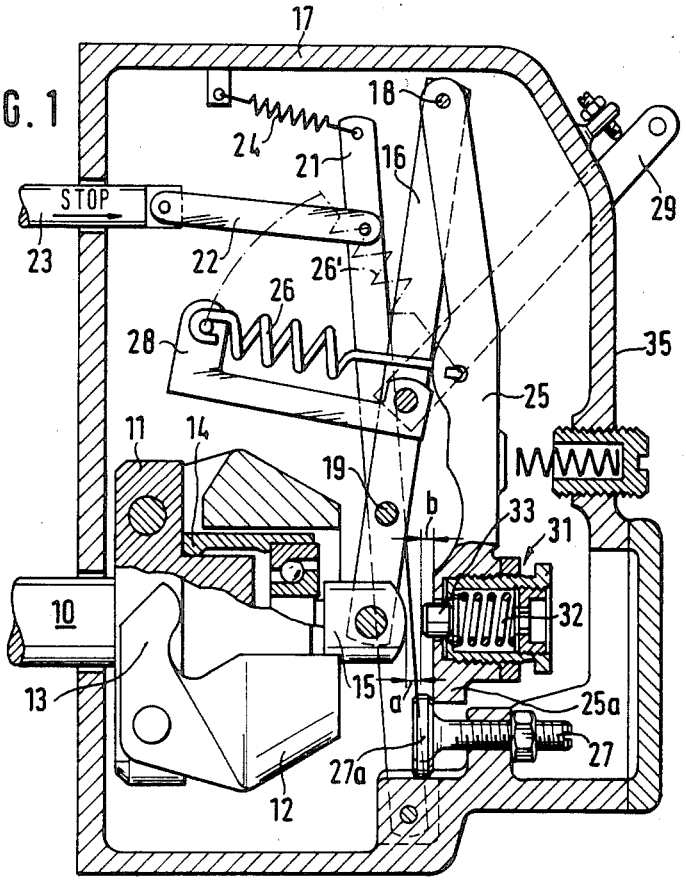
FIG. 1 is a longitudinal section taken through the first exemplary embodiment of a centrifugal rpm governor embodied in accordance with the invention, with the regulator parts shown in their starting position.

A flyweight carrier 11 of a centrifugal rpm governor that is known in terms of its basic design from the EP/RSV governors by Robert Bosch GmbH, D-7000 Stuttgart, Federal Republic of Germany, is secured on the camshaft 10 of an injection pump for internal combustion engines that is known and not otherwise shown. Flyweights 12 are pivotably supported on the flyweight carrier 11. These flyweights 12, with pressure arms 13, engage one end of a governor sleeve 14 acting as a governor member, which transmits the sleeve stroke effected by the flyweights 12 to a sleeve bolt 15. The sleeve bolt 15 is articulated on a guide lever 16, which is pivotable on a bearing pin 18 secured in the governor housing 17 and thus guides the governor sleeve 14 in its stroke movements. A pin 19 secured on the guide lever 16 acts as a pivot bearing for a two-armed intermediate lever 21, which is articulated via a strap 22 on the governor rod 23 of the injection pump, the stop direction of which is indicated by an arrow marked "STOP". A play-compensating spring 24 that acts as both a starting and idling spring and is suspended in the governor housing 17 is secured to the outermost end of the intermediate lever 21.

In addition to the guide lever 16, a lever-like force transmitting member 25 is also pivotable supported on the bearing pin 18; it is held in the position shown, in which it is pressed with its outermost end **25*a* against a head 27*a* of a stop screw 27 acting as the full-load stop by means of the tensional force of a governor spring 26**.

The governor spring 26 is prestressed in a known manner, via a pivot lever 28 pivotably supported in the governor housing 17 by means of an operating lever 29 which extends outside the governor housing 17, for the maximal rpm that is to be regulated. The pivoted position of the governor spring 26 for regulating an idling rpm is indicated by dot-dash lines at 26'.

At the level of the sleeve bolt 15, a torque-control capsule 31 is threaded into a threaded opening in the force-transmitting member 25. The torque-control capsule 31 includes a stop bolt 33 which is stressed by a torque-control spring 32 that cooperates with the sleeve bolt 15 of the governor sleeve 14 in order to direct the torque-control process. In the starting position of the governor parts shown in the drawing, the sleeve bolt 15 is spaced from the stop bolt 33 of the torque-control capsule 31 in the position of rest of the flyweights 12 and governor sleeve 14, by a distance "a". This distance "a" is produced by the force of the initial stress of the spring 24, so that the governor rod 23 is in a position such as to fix an increased starting quantity that is greater than the full-load injection quantity.

The torque-control capsule 31, provided in accordance with the invention with an apparatus for infinitely graduated adjustment of the force of initial stress of the torque-control spring 32 will now be described in greater detail, referring to FIG. 2 which shows it on an enlarged scale.

The torque-control capsule 31 includes a stop housing 34 embodied as a threaded sheath which is threaded on its outside and threaded into the one end of lever 25 from an end face 35 of the governor remote from the governor sleeve 14, into a stepped longitudinal bore 36 of the force-transmitting member 25 and secured in its installed position by a counternut 37. The stop housing 34, includes a stepped longitudinal bore 38 which forms an aperture in one end thereof through which a stop bolt 33 passes. The stop bolt 33 extends through an aperture in member 25 and protrudes beyond the force-transmitting member 25 with its protruding dimension "b", which is dependent on the installed position of the torque- control capsule 31 in the force-transmitting member 25 in order to determine a torque-control stroke. The stop bolt 33 is held in its outset position, shown, by a torque-control spring 32, and the torque-control spring 32 is supported at one end on a head **33*a* of the stop bolt 33 and on the other end on an abutment 41 embodied by an end face of an adjusting screw 39. For receiving the adjusting screw 39, the stepped longitudinal bore 38 of the stop housing 34 has an internal thread 42, and in the vicinity of this internal thread 42 the adjusting screw 39** is secured in a positionally fixed manner solely by means of its special shaping.

Figure 2:
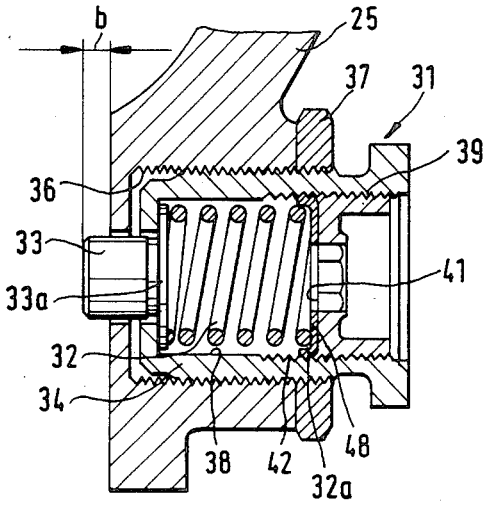
FIG. 2 is a detail of FIG. 1 showing the torque-control capsule on an enlarged scale.
Figure 3:
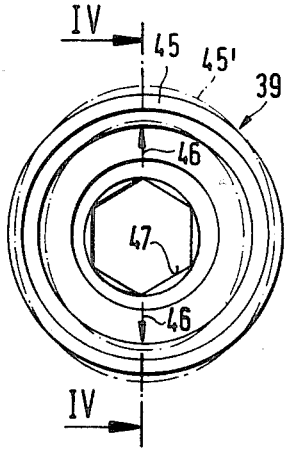
FIG. 3 is a view in the direction of the arrow III in FIG. 4 on the adjusting screw used in the first exemplary embodiment.
Figure 4:
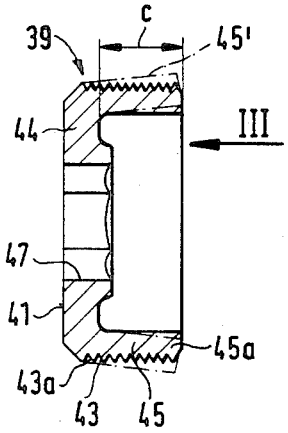
FIG. 4 is a cross section taken along the line IV—IV of FIG. 3.

In FIGS. 3 and 4, the adjusting screw 39 is shown in an end view and a sectional representation, respectively, that are on a still larger scale than FIG. 2. This adjusting screw 39 takes the form of a cup-shaped adjusting ring provided with a continuous external thread 43 and a bottom 44 as well as a hollow-cylindrical, sheath-like wall 45. In order to avoid additional means for positionally securing the adjusting screw 39 inside the internal thread 42 of the stop housing 34, the adjusting screw 39 is deformed into an oval shape over a portion of its length, in the vicinity of the sheath-like wall 45, prior to being installed in the stop housing 34. This deformation of the wall 45 is indicated by dot-dash lines in FIGS. 3 and 4. The circular shape of the sheath-like wall 45 shown by a solid line in the drawing is more or less assumed by this wall 45 in the installed state as well; that is, some of the deformation plastically resumes its initial shape upon being threaded into the internal thread of the stop housing 34; a constant remnant deformation remains on the adjusting screw 39, however, and in the installed state it exerts a tensional force that acts upon the internal thread 42 and thereby assures the desired positional fixation of the adjusting screw 39; this force is dependent upon both the thickness of the wall 45 and the modulus of elasticity and elastic limit of the material used. A very good positional fixation, which meets the demands made of centrifugal rpm governors, is attained, for instance in an adjusting screw 39 provided with a thread M $14\times1$ by means of a wall thickness of approximately 1.5 and a deformation depth "c" (see FIG. 4) of 4 mm. The greatest deformation takes place in an end section **45*a* of the wall 45, as also shown in FIGS. 3 and 4. To this end, the wall 45 is pressed outward ovally, out of the hollow-cylindrical shape it originally had when manufactured, at two diametrically opposed points marked with arrows 46 in FIG. 3, by a total of approximately 0.5 mm and thereby attains the elliptical cross section shown at 45'** in dot-dash lines in FIG. 3.

In the vicinity of the bottom 44 at which its end face forms the abutment 41 for the torque-control spring 32, the external thread 43 retains its normal, circular contour at one end, marked **43*a*, while only at the opposite end, in the vicinity of the end section 45*a* of the sheath-like wall 45 that is open toward the outside, does the greatest deformation take place, corresponding to the deformation of the wall 45. As a result, the adjusting screw 39 can easily be inserted with its first few threads into the internal thread 42 without exerting force, for instance by hand, and then adjusted into the installed position shown in FIGS. 1 and 2 by using an adjusting tool. So that the adjusting tool can engage it, the bottom 44 of the adjusting screw 39 is provided with a central opening 47 formed as a tool receiving recess. This opening 47 is embodied as a hexagon in the present case, so that a conventional Allen wrench can be used as the adjusting tool. In order to make unauthorized intervention difficult, of course this opening 47** may be given some other, irregular form, into which only a special tool can fit.

In order to reduce the torsion on the torque-control spring during the rotation of the adjusting screw and to avoid settling of the torque-control spring 32 and stripping of the spring windings in the internal thread 42, one end **32*a* of the torque-control spring 32 oriented toward the adjusting screw 39 is, as may be seen in FIG. 2, held radially by a hardened spring plate 48 that receives this end 32*a* on its end face. The spring plate 48 rests in turn on the abutment 41 located on the adjusting screw 39 and is guided radially in the longitudinal bore 38 of the stop housing 34**.

Figure 5:
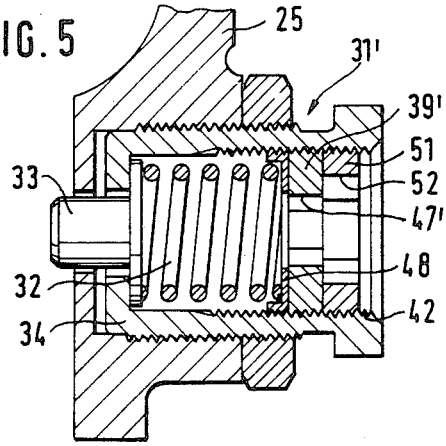
FIG. 5 is a detail of FIG. 1 corresponding to FIG. 2, but with a variant embodiment of the torque-control capsule for the second exemplary embodiment.

In the second exemplary embodiment shown in part in FIG. 5, the adjusting screw 39 is embodied as a first adjusting ring provided with a central tool access opening 47'; for the sake of positional fixation, this first adjusting ring is positionally fixed in its installed position by means of a second adjusting ring 51 that is likewise located entirely inside the stop housing 34 and threaded into the internal thread 42 thereof. The shape of the stop housing 34 and the torque-control spring 32, the stop bolt 33 and the spring plate 48 are practically identical to the corresponding parts in the first exemplary embodiment and thus have identical reference numerals.

The adjusting ring 51, like the first adjusting ring 39', has a central opening 52, which is shaped like the opening 47 of the first adjusting ring 39' but is greater in diameter by a dimension such that two telescoping tubular tools can be used for holding the first adjusting ring 39' firmly and for tightening the second adjusting ring 51 upon locking the established position of the adjusting screw 39'.

The mode of operation of the centrifugal rpm governor according to the invention will now be described, paying particular attention to directing the torque-control process.

To prepare for starting, the operating lever 29 is pivoted, for instance by the gas pedal, into its position shown in FIG. 1 for setting the maximum rpm to be regulated; in this position, the governor spring 26 is pre-stressed in a corresponding manner. By means of the force of the governor spring 26, the force- transmitting member 25 is drawn with its end **25*a* against the head 27*a* of the full-load stop screw 27. In the state of rest of the flyweights 12, effected by the initial stressing force of the spring 24, the governor rod 23 is in its position controlling the starting quantity, and the distance "a" exists between the stop bolt 33 of the torque-control spring 31 and the sleeve bolt 15. The spring 28 serving as the starting spring is however also in a position to adjust the governor rod 23 into the described outset position, if the operating lever 29 is retracted to the idling position (not shown), in which the governor spring assumes the position shown at 26'**.

After starting has taken place and under the centrifugal force of the flyweights 12 that have pivoted outward, the governor sleeve 14 is displaced toward the right, out of the position shown in FIG. 1, and moves the sleeve bolt 15, counter to the force of the starting spring 24, until it contacts the stop bolt 33, which protrudes by the dimension "b". In so doing, the governor rod 23 is retracted in a known manner to its full-load position that has been established for low rpm, if the operating lever 29 is kept in its position shown in FIG. 1. This full-load position is retained by the governor rod 23 until attainment of the rpm at which the stop bolt 33 begins to deflect, in accordance with the initial stress of the torque-control spring 32, and thus initiates the torque-control movement. After the torque-control stroke "b" has been traveled, the torque-control movement is terminated, the sleeve bolt 15 rests on the force-transmitting member 25 and the governor rod 23 is in its full-load position, in which it remains until the attainment of the break-away rpm fixed by the governor spring 26.

If the rpm existing at the onset or end of torque control does not correspond to the rpm fixed by the test specification, then the adjusting screw 39 may be rotated by means of an adjusting tool introduced into the opening 47 at the adjusting screw 39 (see FIG. 2), if necessary even with the governor in operation, and the initial stress of the torque-control spring 32 thereby varied until such time as the torque-control movement begins or ends at the desired rpm. Because of the holding force resulting from the deformation of the wall 45, the adjusting screw 39 is held in any established position, without additional securing means. The torque-control stroke fixed by the protruding dimension "b" and thus substantially the rpm difference as well remain constant and are not affected by a change in initial stress; in other words, the difference in length of the control path, which is proportional to the torque-control stroke, that is traveled by the governor rod 23 in controlling the torque control process retains the value previously established by the protruding dimension "b" of the stop bolt 33. If some other torque-control stroke is required, then this stroke may be adjusted, if necessary with the governor in operation, by rotating the entire torque-control capsule, without varying or affecting the onset of torque control. The established position is secured by the counter nut 37.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A centrifugal rpm governor for internal combustion engines having a governor member adjusting in accordance with the rpm, having a force-transmitting member subject to the force of at least one governor spring and having a torque-control capsule which is threaded in a positionally secured manner into a chamber in a portion of the force-transmitting member which includes a bore in axial alignment with said governor member and which can be acted upon by the governor member, said torque-control capsule includes a stop housing embodied as a screw sheath, said stop housing includes internal and external threads and an inside stepped longitudinal bore, an aperture in said stop housing in alignment with said bore in said chamber, a stop bolt received in said aperture, said stop bolt protrudes through said aperture beyond said bore in said chamber in the force-transmitting member with a dimension of its protrusion (b) which is dependent on the threaded position of the torque-control capsule in the force-transmitting member which determines a torque-control stroke, a torque-control spring, supported on one end on the stop bolt and on another end by a bottom end face of a cup shaped adjusting ring which has contin uous infinitely graduated external adjusting screw threads and is secured in a positionally fixed manner inside said stop housing in the vicinity of its internal thread, said cup-shaped adjusting ring having a hollow-cylindrical, sheath-like wall in which said external adjusting screw threads have a normal, circular outer contour at its bottom end which is in abutment with said torque-control spring, and said adjusting ring is formed into an oval shape over a portion of its length prior to installation, in the vicinity of the sheath-like wall and has its greatest oval deformation in the vicinity of an end section open toward the outer end of the sheath-like wall of said adjusting ring.

2. A centrifugal rpm governor as defined by claim 1, in which the hollow-cylindrically sheath-like wall of the cup-shaped adjusting ring is pressed outward prior to installation into an oval shape in the vicinity of the end section having the greatest deformation at two diametrically opposed points by a total of approximately 0.5 mm and there has an elliptical cross section.

3. A centrifugal rpm governor as defined by claim 2, in which the bottom of the cup shaped adjusting ring is provided with a central opening shaped to receive a tool.

4. A centrifugal rpm governor as defined by claim 1, in which said another end of the torque-control spring is held by a hardened spring plate receiving this end, which spring plate in turn rests on an abutment located on said cup-shaped adjusting ring and is radially guided in the longitudinal bore of the stop housing.

5. A centrifugal rpm governor as defined in claim 1 which includes a lock-ring surrounding said stop housing and threaded against said force transmitting member to lock said stop housing in a screw-threaded position within a portion of said force-transmitting member.

* * * * *